US005551316A

United States Patent [19]

Blank

[11] Patent Number: 5,551,316

[45] Date of Patent: Sep. 3, 1996

[54] RETRACTABLE WINDOW CRANK

[76] Inventor: Jay L. Blank, 74 Summit Ave., Catskill, N.Y. 12414

[21] Appl. No.: 377,060

[22] Filed: Jan. 23, 1995

[51] Int. Cl.[6] ..... G05G 1/00

[52] U.S. Cl. ..... 74/547; 74/526; 242/283; 16/110 R

[58] Field of Search ..... 74/545–548, 526, 74/527; 242/283, 284, 285; 49/324, 329; 16/110 R

[56] References Cited

U.S. PATENT DOCUMENTS

| | | | |
|---|---|---|---|
| 2,727,406 | 12/1955 | Opocensky | 74/547 |
| 3,862,725 | 1/1975 | Geame | 74/547 X |
| 4,222,602 | 9/1980 | Kouth | 74/547 X |
| 4,368,856 | 1/1983 | Neufeld et al. | 74/547 X |
| 4,437,621 | 3/1984 | Sakumoto | 74/547 X |
| 4,524,921 | 6/1985 | Ozaki et al. | 74/547 X |
| 4,588,141 | 5/1986 | Uetsuki et al. | 74/547 |
| 4,858,845 | 8/1989 | Kaneko | 242/285 |
| 4,928,547 | 5/1990 | Huyer | 74/545 |
| 5,368,249 | 11/1994 | Takeuchi | 74/547 X |
| 5,421,180 | 6/1995 | Rojdev | 74/527 X |

FOREIGN PATENT DOCUMENTS

| | | | |
|---|---|---|---|
| 877510 | 5/1953 | Germany | 74/547 |
| 2657850 | 8/1978 | Germany | 74/547 |
| 1154818 | 6/1969 | United Kingdom | 74/547 |

*Primary Examiner*—Vinh T. Luong
*Attorney, Agent, or Firm*—Charles J. Brown

[57] ABSTRACT

For the shaft of a window pivoting device, a retractable crank which includes a socket, a turning arm and a rotatable knob articulated together so that the turning arm can be pivoted between operating and retracted positions with the knob always on the side of the turning arm opposite the socket in the operating position and the same side as the socket in the retracted position, and in the retracted position the knob projects inwardly or downwardly but not outwardly away from the window.

2 Claims, 2 Drawing Sheets

RETRACTABLE WINDOW CRANK

BACKGROUND OF THE INVENTION

Window cranks of the general type with which this invention is concerned are well known for operating a window pivoting device located on the inside of a window. Pivoting devices typically include an axially rotatable actuator stub shaft extending from a housing within which a gear drive is located. It is common that such actuator stub shafts project outwardly and upwardly on the inside of a window, usually on the sill, and are designed to receive a removable crank. Examples of such window pivoting devices and cranks are disclosed in U.S. Pat. Nos. 5,201,241 and 5,168,770.

It is also known to design window cranks to be pivotable between an operating position where they can readily be turned by hand to rotate the actuator shaft and a retracted position folded toward the sill or window, as in the aforementioned U.S. Pat. No. 5,201,241. Retractable cranks for turning actuator shafts in devices other than window pivoting means are also conventional as disclosed in U.S. Pat. Nos. 5,230,290, 3,383,945 and 1,274,471. All of these prior art cranks are of relatively complicated design and in none of them is a crank turning arm articulated with respect to the actuator shaft and a gripping knob to provide optimum retractability.

It is a principal purpose of the present invention to provide a retractable crank specially designed for a window pivoting device which includes one abutment capable of holding a turning arm of the crank in a retracted position with its knob projecting either inwardly toward or downwardly with respect to the sill and window, but not outwardly away from the window. It is also a principal purpose of the present invention to provide another abutment capable of holding the turning arm in its operating position so that when the turning arm is directed upward it is over a dead center position from its retracted position and cannot then fall back to the retracted position.

SUMMARY OF THE INVENTION

The retractable crank of the invention is intended for use with a window pivoting device wherein an axially rotatable actuator stub shaft projects outwardly and upwardly on the inside of a window. A connector is adapted to fit on the stub shaft in fixed turning engagement therewith with its axis coaxial with the stub shaft. A turning arm is pivotable on the connector about a pivot axis substantially perpendicular to the connector axis between operating and retracted positions. Opposite the connector a knob is located on the end of the turning arm and is rotatable about a knob axis substantially coplanar with the connector axis and substantially parallel to the connector axis in the operating position of the turning arm. The knob is on the opposite side of the turning arm from the connector in the operating position and on the same side of the turning arm as the connector in the retracted position. A first abutment surface is provided on the connector adapted to locate the turning arm in its retracted position with the knob projecting other than outwardly away from the window when the connector is fixed to the stub shaft. A second abutment surface is provided on the connector to locate the turning arm in its operating position.

In a preferred form of the retractable crank of the invention the connector is a socket adapted to fit over the stub shaft. The connector axis may be substantially perpendicular to the turning arm in the retracted position. The first abutment surface may be flat and substantially perpendicular to the connector axis to locate the turning arm in its retracted position. When the connector is fixed to the stub shaft the knob projects inwardly toward the window when the turning arm is directed upwardly and it projects downwardly when the turning arm is directed downwardly, but never outwardly away from the window. Also, the second abutment surface on the connector may be flat and at an included angle with respect to the connector axis great enough to locate the turning arm in its operating position over dead center from the retracted position when the connector is fixed to the stub shaft and the turning arm is directed upwardly. A pair of ears may extend from the connector between which the turning arm is pivotable.

DESCRIPTION OF THE PREFERRED EMBODIMENT

Figure 1:
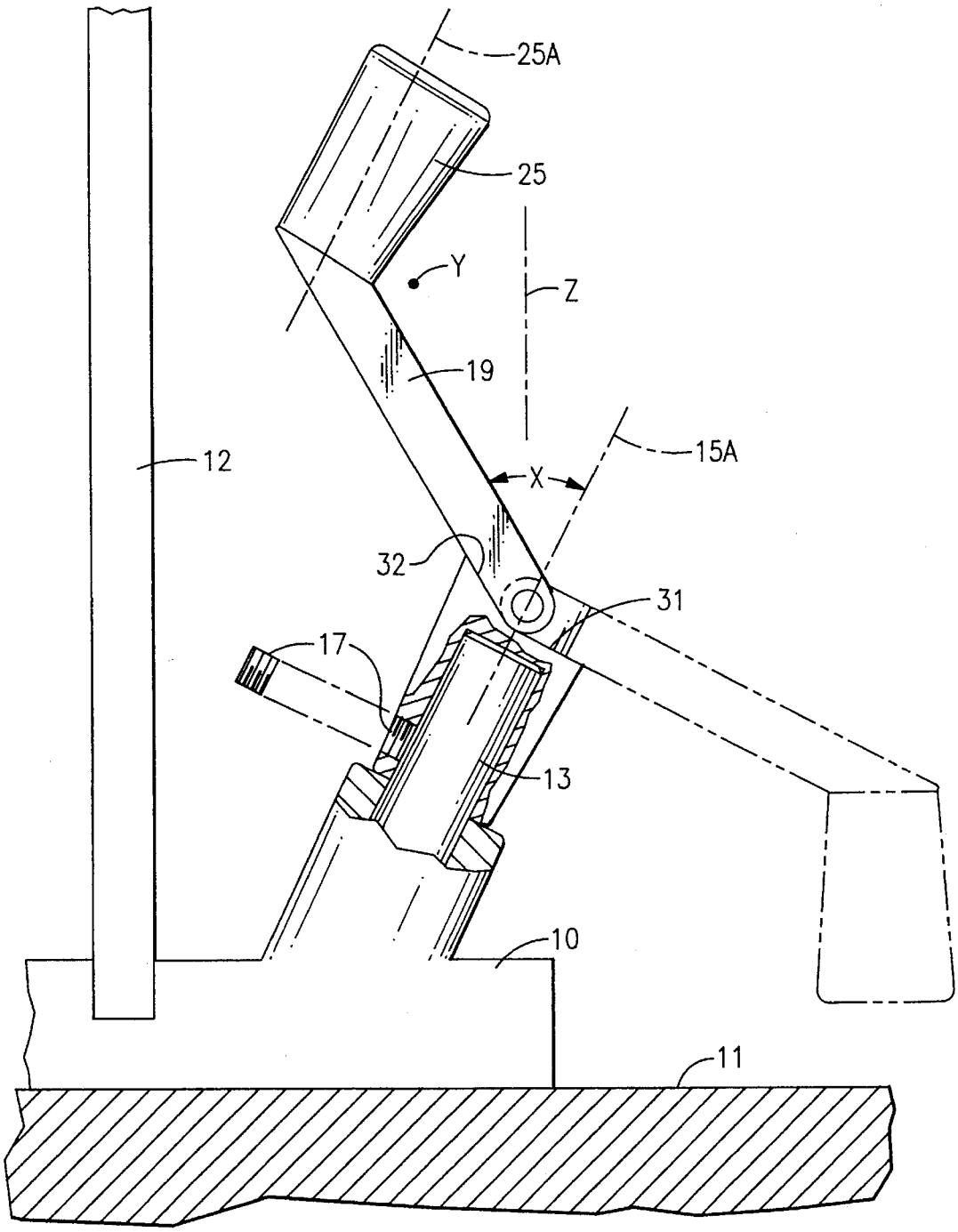
FIG. 1 is an enlarged side elevation partly in section of a window pivoting device on the inside of a window sill with the retractable crank of the invention in place on a stub shaft and showing the crank in solid lines in its operating position and in dotted lines in its retracted position.
Figure 2:
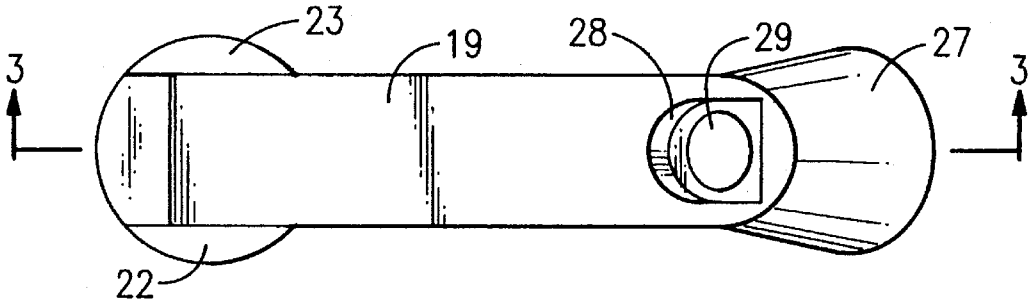
FIG. 2 is a plan view of the socket, turning arm and knob of the crank of the invention removed from the window pivoting device.
Figure 3:
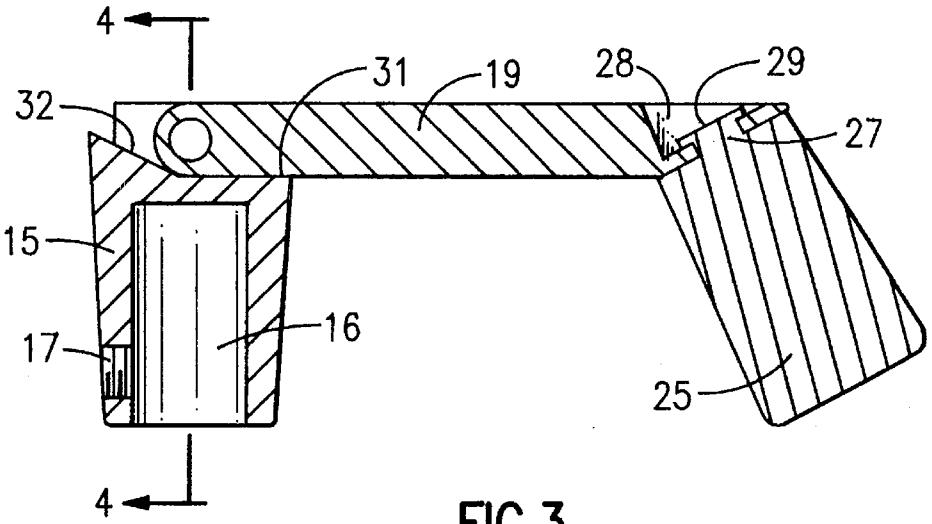
FIG. 3 is a section taken along the line 3—3 of FIG. 2.
Figure 4:
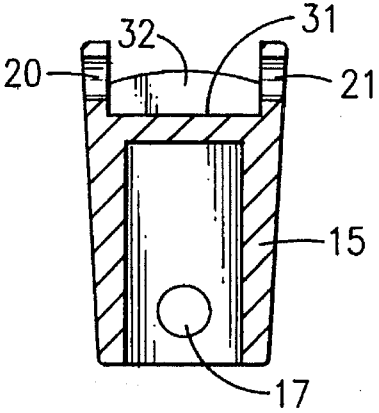
FIG. 4 is a section taken along the line 4—4 of FIG. 3.

Referring first to FIG. 1 a typical window pivoting device includes a housing 10 mounted on a sill 11 on the inside of a window 12. A screen may be the innermost component of a pivotable window assembly and therefore is to be included in the meaning of the term "window" as used herein. Within the housing 10 is a gear train which forms no part of this invention. Whatever the form of the drive, it is actuated by a rotatable stub shaft 13 which projects outwardly and upwardly on the inside of a window at sill level. Such a shaft 13 may be splined for positive rotation.

Referring now to all of the figures this preferred form of the retractable crank of the invention includes a socket 15 or connector formed with an interior cylindrical open-ended bore 16 sized and shaped to fit easily but closely over the stub shaft 13. The socket 15 is secured in fixed turning engagement with the stub shaft 13 by means of a set screw 17 extending through its side wall. The axis 15A of the socket 15 is then coincident with the axis of the stub shaft 13 when the two are assembled together as shown in FIG. 1.

The crank assembly of the invention also includes an elongated turning arm 19 of generally rectangular lateral cross section. At one end the arm 19 has trunnions extending from opposite sides thereof into coaxial holes 20 and 21 in a pair of ears 22 and 23 projecting from the socket 15 opposite its connection with the stub shaft 13. The turning arm 19 is thus pivotable on the socket 15 about a pivot axis through the trunnions 20 and 21 which is perpendicular to the socket axis. Consequently the turning arm 19 can be swung between an operating position shown in solid lines and a retracted position shown in dotted lines in FIG. 1.

Rotatably affixed to the end of the turning arm 19 opposite the socket 15 is a knob 25 which can be turned about its own knob axis 25A. That axis 25A is coplanar with the socket axis 15A and is substantially parallel to the socket axis 15A in the operating position of the turning arm 19 shown in solid lines in FIG. 1. The manner of rotatable connection between the knob 25 and the turning arm 19 is optional. In this embodiment it is shown as a pin 27 on the knob 25 which projects through a hole in the end of the turning arm 19 into a recess 28 and secured in place by a head 29 on the pin 27.

It is an object of this particular construction to provide an articulated three-piece crank assembly comprising the socket 15, the turning arm 19 and the rotatable knob 25 permanently held together to function as a unit for attachment to the stub shaft 13 of a conventional window pivoting device.

A first flat abutment surface 31 is formed on the end of the socket 15 opposite the stub shaft 13 between the ears 22 and 23 and is perpendicular to the socket axis. The first flat abutment surface 31 holds the turning arm 19 in its retracted position shown in dotted lines in FIG. 1 with the knob projecting inwardly toward the window when the turning arm 19 is directed upwardly and projecting downwardly toward the sill 11 when the turning arm is directly downwardly as shown in dotted lines in FIG. 1. The knob in the retracted position never projects outwardly away from the window 12. The socket axis 15A is perpendicular to the turning arm 19 in that retracted position.

A second flat abutment surface 32 is formed on the end of the socket 15 remote from the stub shaft 13 at an included angle marked X in FIG. 1 which is great enough to locate the turning arm 19 in its operating position shown in solid lines in FIG. 1 over dead center from the retracted position shown in dotted lines when the turning arm 19 is directed upward. In other words when the turning arm is turned counterclockwise from the dotted line position as shown in FIG. 1 and its center of gravity, shown for example as the point Y, passes through a vertical plane Z in which the aforementioned pivot axis lies, the turning arm will then fall to the solid line position against the second abutment surface 32. This prevents the turning arm 19 and the knob 25 from falling under its own weight into the retracted position from a twelve o'clock position during the cranking operation.

The axis 25A of the knob 25 is substantially parallel to the axis 15A of the socket 15 at all times during the cranking operation. It will be noted that the end of the turning arm 19 remote from the knob 25 is curved to permit it to turn freely between the abutment surfaces 31 and 32 from the retracted to the operating positions and back.

In operation the socket 15 is fitted over the stub shaft 13 and fixed thereto by means of the set screw 17. In the retracted position shown in dotted lines in FIG. 1 the knob 25 is directed downwardly close to the sill 11 when the arm 19 is at six o'clock and inwardly toward the window 12 when the arm 19 is at twelve o'clock. It never projects outwardly away from the window 12 in the retracted position as is the case in certain prior art designs. When the window is to be cranked open the turning arm 19 is pivoted to the operating position which at twelve o'clock is shown in solid lines in FIG. 1. At that twelve o'clock position the arm 19 and knob 25 are over dead center from the retracted position and hence cannot fall back to the retracted position. The angle of the second abutment surface 32 is such that not only is the over-dead-center feature achieved but also the axis 25A of the knob 25 is substantially parallel to the axis 15A of the socket 15 stub shaft 13 to permit easy cranking of the stub shaft 13 when the knob 25 is turned in a circular fashion. All of these functions are achieved by an efficient unitary three-part assembly of socket and turning arm and knob which is easily secured to and detached from the stub shaft 13.

The scope of the invention is to be determined by the following claims rather than the foregoing description of a preferred embodiment.

I claim:

1. In combination with a window pivoting device wherein an axially rotatable actuator stub shaft projects outwardly and upwardly on a sill on the inside of a window, a retractable crank comprising a) a socket fitted on the stub shaft in fixed turning engagement therewith with its axis coaxial with the stub shaft, b) a pair of ears on the end of the socket opposite the stub shaft, c) a turning arm pivotable on the socket between the ears about a pivot axis perpendicular to the socket axis between operating and retracted positions, d) a knob on the end of the turning arm opposite the socket and rotatable about a knob axis coplanar with the socket axis parallel to the socket axis in the operating position of the arm, e) a first flat abutment surface between the ears on the socket perpendicular to the socket axis to locate the turning arm in its retracted position with the knob projecting inwardly toward the window when the turning arm is directed upwardly and projecting downwardly toward the sill when the turning arm is directed downwardly with the socket axis perpendicular to the turning arm, and f) a second flat abutment surface between the ears on the socket at an included angle with respect to the socket axis locating the turning arm in its operating position over dead center from the retracted position when the turning arm is directed upwardly.

2. In combination with a window pivoting device wherein an axially rotatable actuator stub shaft projects outwardly and upwardly on a sill on the inside of a window, a retractable crank comprising a) a socket fitted on the stub shaft in fixed turning engagement therewith with its axis coaxial with the stub shaft, b) a turning arm pivotable on the socket about a pivot axis perpendicular to the socket axis between operating and retracted positions, c) a knob on the end of the turning arm opposite the socket and rotatable about a knob axis coplanar with the socket axis parallel to the socket axis in the operating position of the arm, d) a first flat abutment surface perpendicular to the socket axis to locate the turning arm in its retracted position with the knob projecting inwardly toward the window when the turning arm is directed upwardly and projecting downwardly toward the sill when the turning arm is directed downwardly with the socket axis perpendicular to the turning arm, and e) a second flat abutment surface on the socket at an included angle with respect to the socket axis locating the turning arm in its operating position over dead center from the retracted position when the turning arm is directed upwardly.

* * * * *